US009044123B2

(12) United States Patent
Gomez Espana Collignon

(10) Patent No.: US 9,044,123 B2
(45) Date of Patent: Jun. 2, 2015

(54) DEVICE COMPRISING ACTUATING MECHANISMS FOR LIFTING AND LOWERING THE COVER AND THE SEAT OF A WC, INDEPENDENTLY FROM EACH OTHER OR SIMULTANEOUSLY

(76) Inventor: Carlo Gomez Espana Collignon, Jalisco (MX)

( * ) Notice: Subject to any disclaimer, the term of this patent is extended or adjusted under 35 U.S.C. 154(b) by 0 days.

(21) Appl. No.: 14/000,331

(22) PCT Filed: Feb. 17, 2012

(86) PCT No.: PCT/MX2012/000018

§ 371 (c)(1),
(2), (4) Date: Aug. 19, 2013

(87) PCT Pub. No.: WO2012/112021

PCT Pub. Date: Aug. 23, 2012

(65) Prior Publication Data

US 2013/0318696 A1 Dec. 5, 2013

(30) Foreign Application Priority Data

Feb. 18, 2011 (MX) ..... MX/a/2011/001905

(51) Int. Cl.
*A47K 13/10* (2006.01)

(52) U.S. Cl.
CPC ..... *A47K 13/10* (2013.01)

(58) Field of Classification Search
CPC ..... A47K 13/10; A47K 13/12
USPC ..... 4/241, 246.1, 246.2, 248
See application file for complete search history.

(56) References Cited

U.S. PATENT DOCUMENTS

| | | | | |
|---|---|---|---|---|
| 4,291,422 | A | 9/1981 | Shoemaker et al. | |
| 4,984,666 | A | 1/1991 | Orii et al. | |
| 6,070,298 | A | 6/2000 | Sorimachi | |
| 6,321,393 | B1 * | 11/2001 | Jones | 4/246.1 |
| 6,643,852 | B1 | 11/2003 | Lin | |

(Continued)

FOREIGN PATENT DOCUMENTS

| | | |
|---|---|---|
| EP | 0337477 | 10/1989 |
| GB | 2376475 | 12/2002 |
| MX | 01006808 | 1/2003 |

(Continued)

OTHER PUBLICATIONS

International Search Report for PCT/MX2012/000018, English translation attached to original, Both completed by the Mexican Patent Office on Jul. 25, 2012, All together 8 Pages.

*Primary Examiner* — Tuan N Nguyen
(74) *Attorney, Agent, or Firm* — Brooks Kushman P.C.

(57) ABSTRACT

A device having mechanisms for lifting and lowering the cover and the seat of a toilet (WC), including a structure fixed to the rear part of a WC and designed to house a first and second axle arranged co-linearly and fixed on the ends of the cover and the seat, respectively. The first and second axles include on the adjunct ends a first mechanism with a first and second gear designed to engage with a third actuating gear arranged below the aforementioned gears on a fixed axle, the fixed axle being engaged and driven by a toothed element with an ascending course of a first hydraulic piston powered by pressurized water. The device also includes a second mechanism with a hydraulic piston powered by pressurized water for rotating the axles in the opposite direction in order to automatically lower the cover and seat when the WC tank is emptied.

20 Claims, 12 Drawing Sheets

(56) References Cited

U.S. PATENT DOCUMENTS

| | | | |
|---|---|---|---|
| 7,636,956 | B1 | 12/2009 | Doucet |
| 2004/0060104 | A1 | 4/2004 | Nishikawa et al. |
| 2006/0242755 | A1 | 11/2006 | Lohss |
| 2013/0007952 | A1 | 1/2013 | Gomez-Espana Collignon |
| 2013/0160196 | A1 | 6/2013 | Gomez Espana Collignon |

FOREIGN PATENT DOCUMENTS

| | | |
|---|---|---|
| MX | 2009009461 | 3/2010 |
| MX | 2009005262 | 5/2010 |
| WO | 9510971 | 4/1995 |
| WO | 2005102136 | 11/2005 |
| WO | 2007089459 | 8/2007 |

* cited by examiner

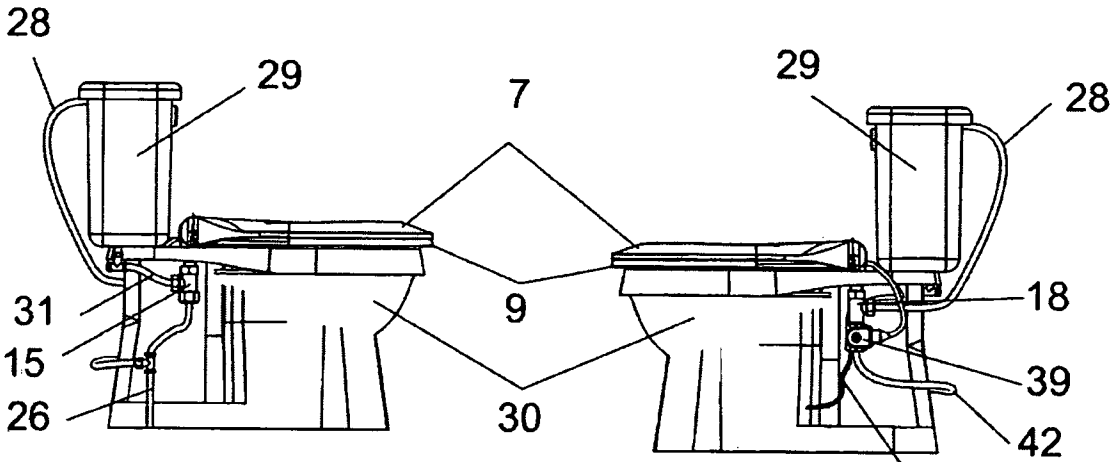
FIG. 8
FIG. 9
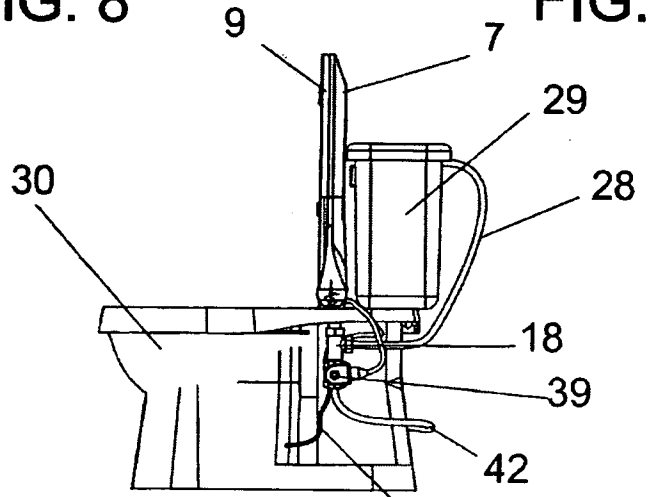
FIG. 10

DEVICE COMPRISING ACTUATING MECHANISMS FOR LIFTING AND LOWERING THE COVER AND THE SEAT OF A WC, INDEPENDENTLY FROM EACH OTHER OR SIMULTANEOUSLY

CROSS-REFERENCE TO RELATED APPLICATION

This application is the U.S. national phase of PCT Application No. PCT/MX2012/000018 filed on Feb. 17, 2012, which claims priority to Mexican Patent Application No. MX/a/2011/001905 filed on Feb. 18, 2011, the disclosures of which are incorporated in their entirety by reference herein.

FIELD OF THE INVENTION

The present invention relates to the means and devices used in toilets or lavatories, particularly relates to means used for simultaneously or independently raise and lower the lid and seat of a toilet, and more specifically, relates to a novel device with driving mechanisms for raise the lid and seat of a toilet independently or simultaneously and down them after the use of the toilet without use of hands.

BACKGROUND OF THE INVENTION

As is well known, commonly used toilets are shaped in such a way that structurally comprise a bowl consisting of a body having a central cavity of round or oblong hole, with an internal trap that discharge in a base fixed to the floor and where the exit of the trap is connected to the sanitary drainage network, said bowl comprising an upper tank where a volume of water is deposited, which is connected through a duct to said bowl, wherein said ducts comprise a ball-cock supply valve with driving means for discharging water into the bowl.

A water supply duct from a water supplying source of domestic network or public network is connected directly into the water storage upper tank, comprising or not a control bypass valve; wherein said tank includes valve means controlled by a float element to control the volume of water to be stored and downloaded to the toilet, so as to dislodge micturitions and/or feces.

The toilet bowl hole comprises in the back part some orifices where are inserted fixing means of a lid that cover the bowl hole and a seat which are collapsible in a circular or horseshoe way, disposed below the lid and over the edge of the bowl hole, that is used for reasons of hygiene to prevent the user from having direct contact with the toilet surface, as well as provide greater comfort to the user.

The covering lid of the bowl consists of a solid body in a similar shape to the hole (round or oblong) and the seat has an annular or elliptical shape that follows the contour of the bowl hole, some seats are shaped like a horseshoe. Said seat is used so that people seat on it and avoid direct contact with the bowl surface; in some cases the seat is padded for comfort, while the lid allows covering the bowl hole.

When a female person uses the toilet, usually tends to lift the lid with at least one hand, which implies contamination, poor hygiene, etc.

As for a male person, is well known existing problems, as when a man only seeks urinate, usually if it has a good habit, lifts with his hands both the lid and the seat to avoid splashing the seat with urine and keep clean the seat, when the toilet is used to defecate, with the sanitary implications already indicated by the direct contact of the hand with the lid and seat.

But in many cases the man only lift the lid, or if the lid is already raised, they do not raise the seat, which imply that when they urinate, to splash and get wet with urine the seat, causing displeasure in other users and causing contamination of the lid that could be a source of infection for others users, especially when one of those users who have a bad habit and do not lift the lid, have some infectious disease contagious through urine.

In the prior art, were found various mechanisms and mechanical devices, hydraulic and pneumatic that allow lift the toilet lid and/or seat, as an example are cited the following documents as reference, the patent application PA/a/2001/006808; the patent application GB 2376475 (A), the utility model MX1636, the Mexican patent application Pa/a/2006/012503, the U.S. Pat. No. 4,291,422, among others.

Also in the patent application by the same inventor Carlo Gomez Espana Collignon MX/a/2009/005262 filed May 18, 2009, entitled hydraulic driving device for raising and lowering the cover lid and seat of a toilet, and actuator method, as in the patent application also by the same inventor MX/a/2009/009461 also filed Sep. 4, 2009, which has already been granted and is in process of issuing the corresponding title. Said application relates to improvements to the hydraulic driving device for raising and lowering the covering lid and the seat of a toilet, makes a remembrance of the state of the art and describes the major drawbacks of various devices that perform the same operation, which are made extensive to the present description by reference.

Mexican patent application MX/a/2009/005262, is intended to protect a hydraulic driving device for raising and lowering the covering lid and seat of a toilet, characterized by comprising a casing comprising two hollow chambers attached, one left and one right, the cameras housing a left rotating shaft and a right rotating shaft, respectively; both axes fixedly comprise a counterweight that can rotate together with the shaft within the chambers; each chamber also houses a left and right resilient diaphragm, attached and interacting with the counterweights, said diaphragms comprise at least one connecting pivot where is connected a supplying duct and/or working fluid exit to actuate-push the counterweight when they are inflated with working fluid supplied by an automatic system or by a contact driving elements system and cause the rotation of said shafts connected to a cover and a seat of a toilet, respectively, and which comprise at the back part, a left and a right connecting flange with orifice through which is inserted a left and right fixing bolt which is fixed at the ends of the rotating shafts with the corresponding counterweights.

The application MX/a/2009/009461 seeks protection of improvements for a hydraulic driving device to raise and lower the covering lid and seat of a toilet, of the kind formed by two left and right modules linked together, where each module has their respective elements and has the same conformation, characterized by said left and right modules comprise a casing, internally comprising an central transverse axis whose ends protrude and wherein said casing is internally divided into three semicircular recesses; the left axis end is attached to the lid and the right axis end to the seat, the opposite end being fixed to a drive plate of three flange, remaining housed in each cavity of the casing; each cavity also houses a cylindrical diaphragm attached to each of the flanges, which when are filled with water to press the flanges simultaneously causing partial rotation of the axes which being coupled to the lid (left axis) or to the seat (right axis) lift them together or separately or fold down them in its rotational movement when discharged; said diaphragms are connected and fed via a check valve, first adapted to allow the passage of water supply to fill up the diaphragms when is actuated one of the actuating valves by the foot or hand, arranged on the floor in the left and right side of the toilet, and second to drain the water and empty the diaphragms through a pipeline to the toilet tank when is actuated the toilet button to discharge the same and activate the check valve; said left and right valves of foot actuation are connected to a general water distributor and is connected to the water supply duct of the supply network which supplies the toilet tank.

In both applications the devices operate based on diaphragms that must be filled with water to drive some shafts through some flanges, which are attached at their ends to a cover and seat to raise and lower in their turns. The device offers multiple embodiments in the two applications, but requires of multiple hydraulic connections that make complex the assembly, the operation and activation by the users.

Also involves the installation of large, bulky bodies for multiple connections and water distributions and its installation is complex, time-consuming and requires specialized personnel, among other multiple disadvantages.

In any document located is protected or disclosed a device with driving mechanism to rise the lid and the seat of a toilet independently or together, in a practical, efficient and functional manner; comprising driving means by pedal or activation sensing means to actuate hydraulic elements that can partially swivel the lid and seat to lift, and with mechanisms for automatically fold down them once the water from the tank is discharged to discharge the toilet.

The device as conceptualized is novel and involves an inventive step because it has been designed and developed after multiple tests, developments, research, financial resource investment, personnel and supplies, which allowed obtaining the device which can not inferred by a technician with average knowledge in the field of information of prior art.

OBJECT OF THE INVENTION

The main objective of the present invention is to make available a device with mechanisms for raising and lowering the lid and the seat of a toilet, independently or jointly, so as to avoid the use of hands and avoid wetting the seat with urine when is used by men to urinate in the toilet.

Another object of the invention is to make available such a device with mechanisms for raising and lowering the lid and the seat of a toilet, independently or jointly, which also provide greater safety and hygiene to the toilet users.

Another object of the invention is to make available such a device with mechanisms for raising and lowering the lid and the seat of a toilet, independently or jointly, also avoid the possibility of infection by users, avoiding splashing of seat with urine.

Another object of the invention is to make available such a device with mechanisms for raising and lowering the lid and the seat of a toilet, independently or jointly, that is also structurally simple, easy to manufacture, easy to drive and easy to install.

Another object of the invention is to make available such a device with mechanisms for raising and lowering the lid and the seat of a toilet, independently or jointly, which also can be operated indirectly with the use of drive sensors and directly with contact driving elements as a pedal valve.

And all those qualities and objectives that will become apparent from the description of the present invention supported by the illustrated embodiments.

SUMMARY OF THE INVENTION

Generally the device with mechanisms for raising and lowering the lid and seat of a toilet, independently or jointly in accordance with the present invention comprises a casing-support structure adapted to receive a rotatable first axis and a second axes disposed collinearly and partially separated at their ends enclosed within the support-casing structure, the first axis being longer and being attached at the end which protrudes laterally from said support-casing structure from the back side part of the toilette lid; said second axis is short and protrudes at its end on the opposite side of said support-casing structure to be fixed at the back side part of a toilet seat.

Said first axis and second axis comprise at the collinear ends enclosed within the support-casing structure, a first mechanism to allow a first rotation in one direction of said axes and thereby the lifting of the lid and seat; said first mechanism comprises a first gear and a second gear, fixed on a recess of the corresponding ends of said first axis and second axis; adapted to engage with a third driving gear disposed under the latter in an axis fixed within said support-casing structure and which is engaged and driven by an indented element of upward movement of a first driving device.

Said device optionally or jointly comprises a second mechanism to allow a second turn in opposite direction of said axes and hence to lower the lid and seat simultaneously or independently once the toilet has been left to use; which comprises an element of upward stroke of a second driving device for push and rotate optionally a first cam mounted on said first axis fixed to said lid and to push simultaneously or separately a second cam fixed on a third hollow axis mounted on said first axis independently rotatable and fixed in one of its ends of said seat.

Said first driving device of the first mechanism for allowing a first turn in a first direction of said axes and hence the lifting of the lid and seat, consists of a hydraulic piston which comprises a rod-rack as element indented of upward stroke; said hydraulic piston is fixed to the back lower part of said toilet by means of a hollow fixing member that penetrates a hole provided in said toilet and which also holds said support-casing structure for fixing it also above the toilet in the back part of the hole thereof. Through the cavity of said fastening element said rod-rack of the piston moves and penetrates through an office of said support-casing structure for engaging with said third driving gear to in turn drive in a first time said first gear and in a second time said second gear mounted on said first and second axes to rotate them and in turn lifting the lid and seat.

Said hydraulic piston is connected either to a contact driving valve connected to a pressurized water supply source or a solenoid valve operated by presence optical sensor connected to a pressurized water supply source, and being connected by means of a relief duct to the upper part of the water storage tank for the toilet discharge when the piston is deactivated and returns to its resting position, by effect of an internal spring means. The rod-rack of said hydraulic piston comprises a recoil enveloping spring that returns back the rod-rack to its resting position when pressure ceases to exist due the water flow, when is deactivated the contact driving valve or said solenoid valve; in the recoil of the rod-rack without activating the gears it down and water is evacuated through said relief duct to the upper part of the water storage tank of the toilet.

Said toilet seat of circular, elliptical or horseshoe shape comprises a pair of lateral projections at the back part, disposed inside and attached to a pair of lateral lugs of the back part of said lid, where the axes are connected.

In one of the preferred embodiments of the invention, said contact driving valve consists of a pedal valve that is connected through a first conduit to the pressurized water supply conduit and through a second conduit to said hydraulic piston.

In its preferred embodiment said third driving gear consists of a cylindrical gear comprising a semicircular external protrusion and comprising a indented central zone that runs around the perimeter including the semicircular protrusion; said protrusion comprises two indented arrays one on the left side and one on the right side of the indented central zone, offset in position so that they get combine with said teeth of the central zone; so that said teeth of the peripheral central zone are adapted to receive the rod-rack teeth of the piston and said two indented arrays of the protrusion at each side of the indented central zone of said gear, are adapted to engage with said first gear and second gear for coupling on two times Said gears of the first and second axes in the preferred embodiment consist of gears comprising an orifice through which is inserted the end of the corresponding axis and an indented semicircular protrusion that will engage in the corresponding indented arrays of the protrusion of said third driving gear.

In the embodiment of contact driving valve (pedal) in the device operation, depressing said pedal operates the valve and allows the water flow from the supplying source to said piston to actuate it, if it is left pressed by a short time, to lift the rod-rack of the piston it is sufficient that in its ascent engages said third driving gear which in turn engage in a first time with a first indented array on said first fixed gear to the first axis to make it rotate and being attached at its end to the lid, gradually lift it. If the pressure is kept for a longer time, with the water passage said rod-rack continues its ascent movement further rotating said third driving gear which in a second time with a second indented array engages said second gear fixed to the second axis to rotate and being attached at its end to the seat, gradually lift it.

In the driving embodiment with two-way solenoid valve, said solenoid valve is connected at the bottom part of water inlet of the hydraulic piston and comprises an presence optical sensor in communication with a motherboard and said valve to detect the presence of a user and actuating the two-time valve; in the first time when it detects the presence of a user passing the foot or hand by one side of the toilet, the solenoid valve lets pass a water flow from the supplying source to said piston to drive it, so that the rod-rack of the piston that in its ascent engages said third driving gear which in turn engages in a first time with a first indented array on said first gear fixed to the first axis and rotate it and being attached at its end to the lid, gradually lift it; if also it is desired to lift the seat, again it is detected the presence of a user passing the foot or hand by a side of the toilet, so that the valve lets pass more water into the hydraulic piston and the rod-rack continues its ascent stroke further rotating said third driving gear which in a second time with a second indented array engages said second gear fixed to the second axis to rotate it and being attached at its end to the seat, gradually lift it.

In either of the two scenarios, when water left to pass, said recoil enveloping spring that makes recoil the rod-rack back to its resting position without operating the first and second gears and the water inside the piston is discharged through said relief duct to the upper part of the water storage tank of the toilet.

Said second driving device of the second mechanism for lowering the lid and seat simultaneously or independently by the effect of a second rotational movement in the opposite direction of said first and second axes, consists of a second hydraulic piston of fold down comprising a lower connection where a water supply duct is connected from a supply source and internally houses a rod as upward stroke element comprising a recoil enveloping spring; said piston comprises a first lower hole for water inlet that is in communication with a second transverse hole which allows the water supply through a side exit of the piston connected through a supplying duct to the bottom intake of the water storage tank of the toilet for filling it when is discharged by pressure differential effect.

When the toilet is actuated to discharge the water from the tank and dislodge the waste from the toilet, it is generates a pressure differential that allows the pressurized water flow to the second piston of fold down from the supplying source to refill the tank as already described and simultaneously is actuated the rod of the piston that comprises fixedly at its upper end a cross shaped thrust cam, which in its upward stroke abuts and pushes said first cam mounted on said first axis fixed to said lid and to push simultaneously or separately a second cam fixed on a third hollow axis mounted on said first rotatable axis independent and fixed to one of its ends of said seat, so that allows fold down the lid and seat simultaneously, or separately by effect of secure elements.

Said casing comprises secure elements to prevent fold down or lower the lid and locking elements which locks the piston element to prevent fold down or lower the lid and seat; said secure element comprises a button of horizontal stroke mounted on a horizontal groove of said casing and being connected to a guide rail element which embraces a projection of said first cam, which being slidably embraced by said first elongate axis attached to the lid, can move horizontally to remove said first cam and prevent the contact with the cross shaped thrust cam; in this way the axis is disabled from the lid and prevents the lid is lowered when the water tank is discharged, pushing only the second cam fixed on said third hollow axis mounted to said first rotatable axis independent and fixed to one of its ends of said seat in order to fold down or lower the seat only.

Said locking element comprises a button slidably mounted in a horizontal groove of the casing and which comprises fixedly a locking cam; so that when said button slides horizontally said locking cam moves obstructing the upward stroke of the piston rod and prevents that when is discharged the toilet water tank, the lid and seat go down automatically.

To better understanding of the features of the invention, are attached to this description as an integral part thereof, the drawings with illustrative but not limiting character, as described below.

BRIEF DESCRIPTION OF THE FIGURES

FIG. 8 shows a right side view of a toilet with the device with driving mechanisms for raising and lowering the lid and seat of a toilet in accordance with the embodiment shown in FIGS. 5 and 6.

FIG. 9 shows a left side view of a toilet with the device with driving mechanisms for raising and lowering the lid and seat of a toilet in accordance with the embodiment shown in FIGS. 5 and 6.

FIG. 10 illustrates the same view of FIG. 8, but with the lid and seat raised.

Figure 1:
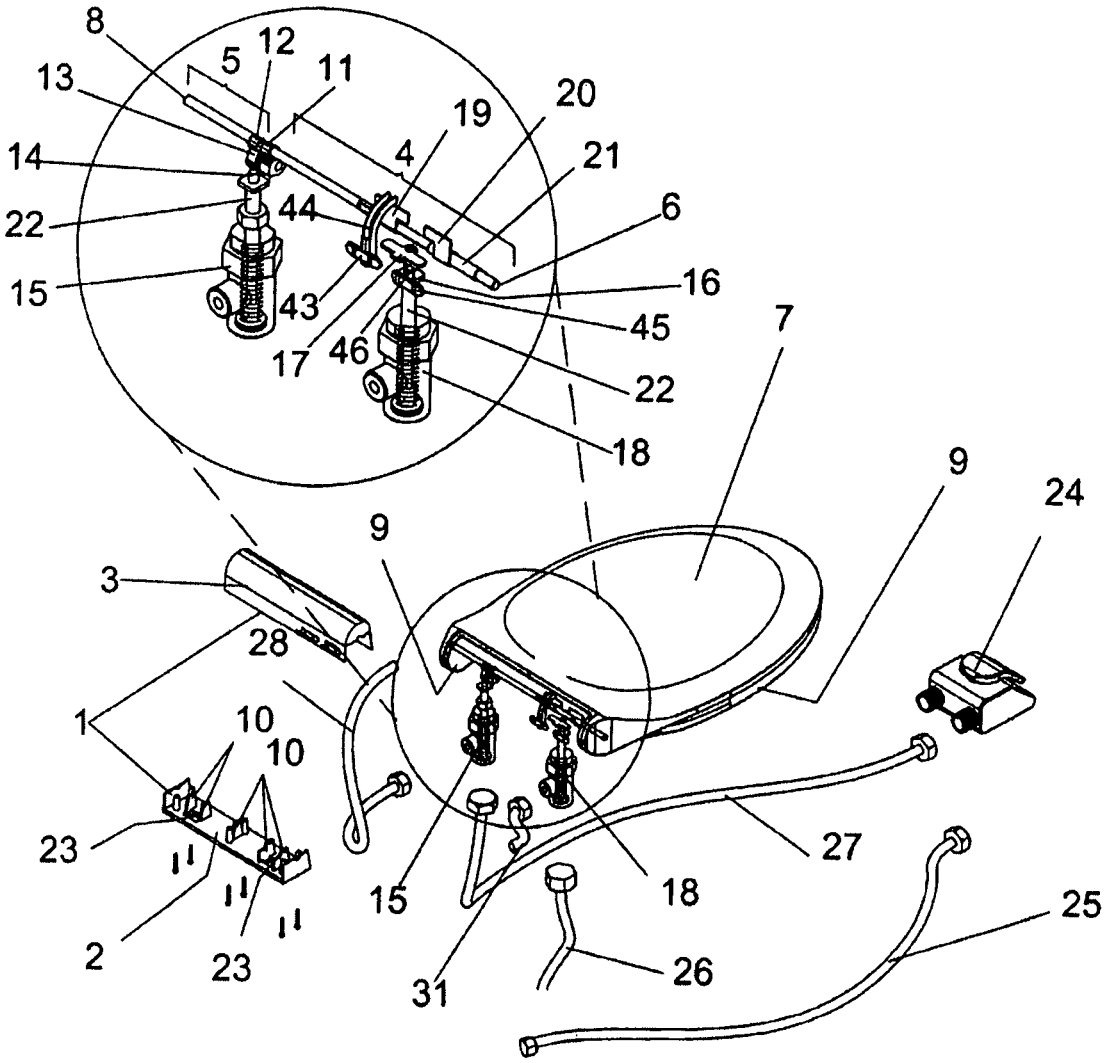
FIG. 1 shows an exploded view of the device with driving mechanisms for raising and lowering the lid and seat of a toilet, in one of the preferred embodiments in accordance with the present invention.
Figure 2:
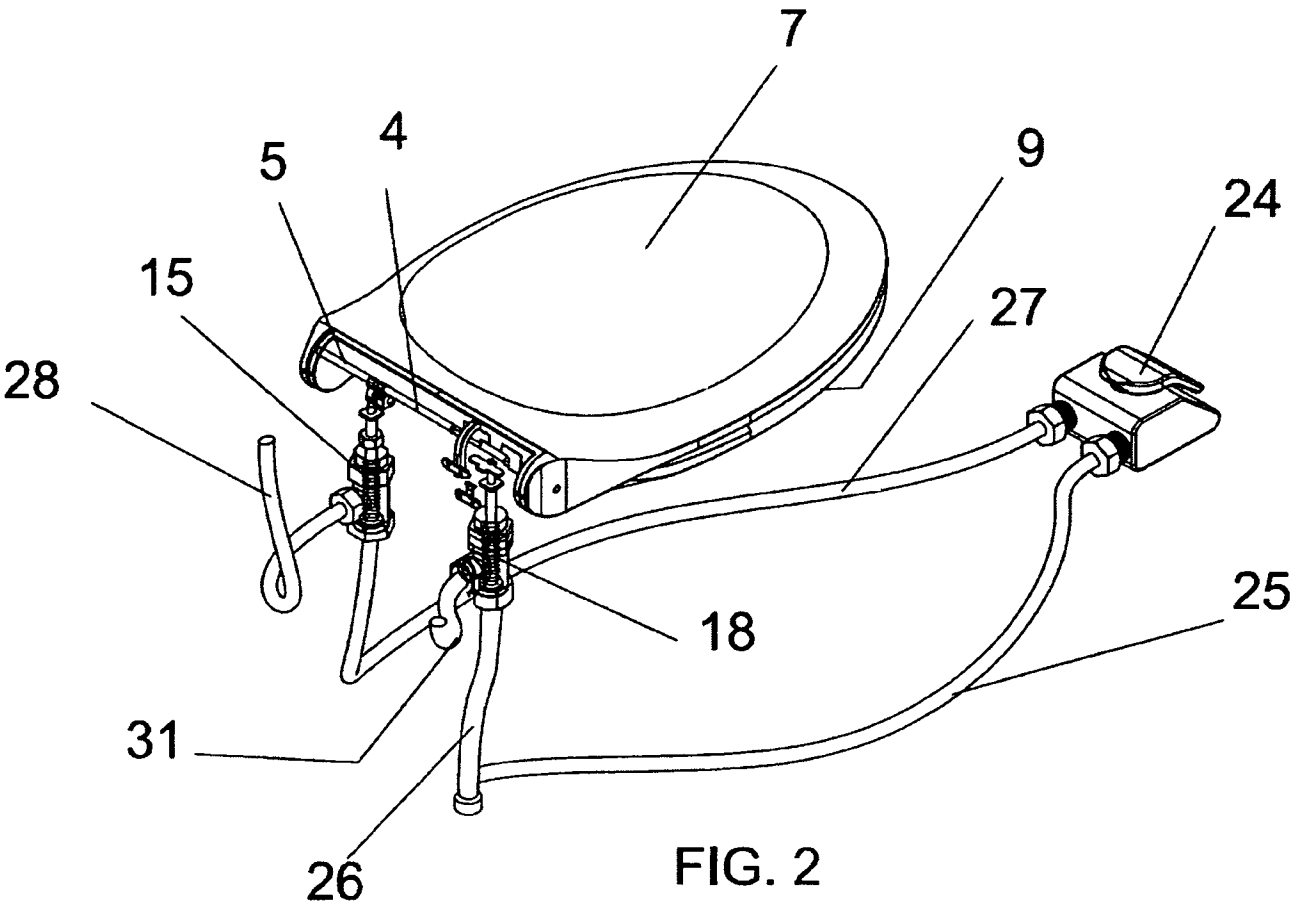
FIG. 2 shows a conventional perspective view of the device with driving mechanisms for raising and lowering the lid and seat of a toilet, in the embodiment shown in FIG. 1.
Figure 4:
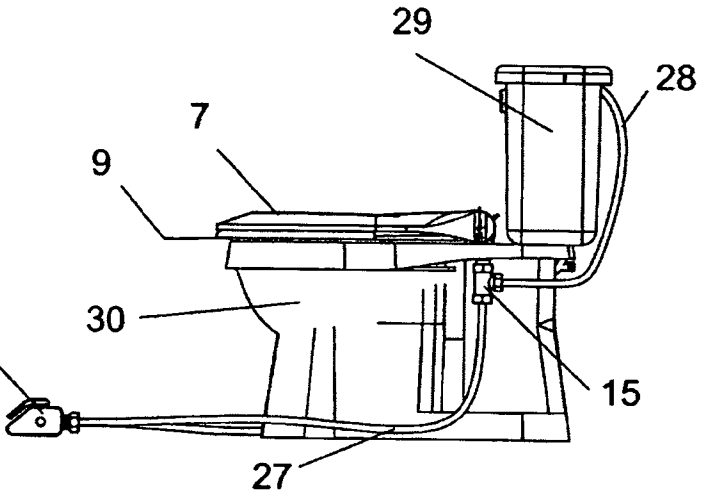
FIG. 4 shows a left side view of a toilet with the device with driving mechanisms for raising and lowering the lid and seat of a toilet in accordance with the embodiment shown in FIGS. 1 to 2.
Figure 3:
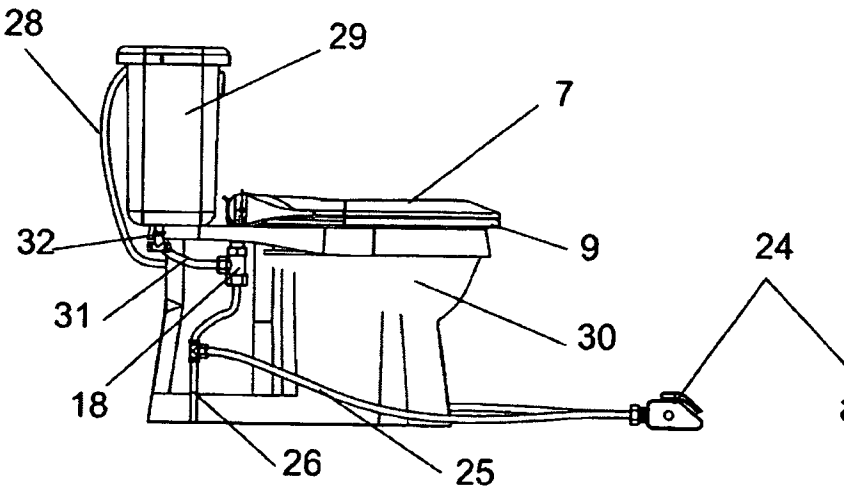
FIG. 3 shows a right side view of a toilet with the device with driving mechanisms for raising and lowering the lid and seat of a toilet in accordance with the embodiment shown in FIGS. 1 to 2.

For a better understanding of the invention, the detailed description of some embodiments of the same will be made, shown in the drawings which for illustration but not limiting purposes are appended to the present description.

DETAILED DESCRIPTION OF THE INVENTION

The characteristic details of the device with driving mechanisms for raising and lowering the lid and seat of a toilet, independently or simultaneously, is shown clearly in the following description and the annexed illustrative drawings, serving the same reference signs to indicate the same parts.

Referring to FIGS. 1 to 4, the device with mechanisms for raising and lowering the lid and the seat of a toilet, independently or jointly in accordance with the present invention comprises a support-casing structure 1 defined by a support base 2 and a cover 3, said base being adapted to rotatably accommodate a first axis 4 and a second axis 5 arranged collinearly and partially separated at their ends enclosed within the support-casing structure 1; being the first axis 4 longer and being attached at the end 6 that protrudes laterally from said support-casing structure 1, on the back side part of the lid 7 of a toilet; said second axis is short and protrudes at its end 8 on the opposite side of said support-casing structure 1 to be fixed at the back side part of a toilet seat 9.

Said support base 2 of the support-casing structure 1 comprises vertical support means 10 where rest and rotate said first axis 4 and second axis 5.

Said first axis 4 and second axis 5 comprise in the collinear ends enclosed within the support-casing structure, a first mechanism to allow a first rotation in one direction of said axes and thereby the lifting of the lid and seat; said first mechanism comprises a first gear 11 and a second gear 12 fixed in a recess of the corresponding ends of said first axis 4 and second axis 5; adapted for engagement with a third driving gear 13 disposed below them on an axle (not shown) fixed within said support-casing structure 1 and which is engaged and driven by an indented element 14 of upward stroke of a first actuator device which in this embodiment consists of a pneumatic piston 15.

Said device comprises jointly in its preferred embodiment, a second mechanism to allow for a second turn in the opposite direction of said axes first 4 and second 5 and hence to lower the lid 7 and seat 9 simultaneously or independently, once the toilet has been left to use; which comprises an upward stroke element 16 with an thrust cam 17 at its end of a second actuating device which in this preferred embodiment consists of a second hydraulic piston 18, to push and turn optionally a first cam 19 mounted on said first axis 4 fixed to the lid 7 and to push simultaneously or separately a second cam 20 fixed in a third hollow axis 21 mounted on said first rotatable axis 4 independent and fixed at one of its ends of said seat 9.

Said first hydraulic piston 15 to allow a first turn in one direction of said axes 4 and 5, and therefore the lifting of the lid 7 and seat 9, comprises a rod-rack as indented element of upward stroke 14. Said first hydraulic piston 15 and second hydraulic piston 18 are fixed to the bottom back part of said toilet 30 through a fixing hollow element 22 which penetrates in an orifice provided in said toilet 30 and which also secures said support-casing structure 1 to fix it at the same time above the toilet in the back part of the hole thereof.

Through the hole of said fixing element 22 of the first hydraulic piston 15 moves said rod-rack of the piston as indented element 14 of upward stroke and through said fixing hollow element 22 of the second hydraulic piston 15 said upward stroke element 16 moves with a thrust cam 17; which penetrate through an orifice 23 of said supporting base 2 of the support-casing structure 1 for actuating the lifting or lowering mechanisms of the lid 7 and seat 9.

This rod-rack 1 of the first hydraulic piston 15 as an indented element 14 of upward stroke engages with said third driving gear 13 in order to in turn actuate in a first time said first gear 11 and a second time said second gear 12 mounted on said first and second axes to rotate them and in turn lift the lid 7 and the seat 9.

Said first hydraulic piston 15 is actuated by effect of the passage of a pressurized water flow of and in this preferred embodiment the flow is controlled by a pedal valve 24 which is connected through a first conduit 25 to the pressurized water supply conduit 26 and through a second conduit 27 to said first hydraulic piston 15 which in turn is connected via a relief duct 28 to the upper part of the water storage tank 29 for discharge of the toilet when the piston is deactivated and returns to its resting position, by effect of an internal spring means (not shown). The rod-rack 14 of said first hydraulic piston 15 comprises a recoil enveloping spring (not shown) which makes it return to its resting position when pressure ceases to exist by the water flow, when the pedal valve 24 is deactivated; in the recoil of the rod-rack is descended without actuate the gears and the water is displaced through said relief duct 28 to the upper part of the water storage tank 29 of the toilet 30.

Said second hydraulic piston 18 of fold down comprises a bottom connection in which the water supply conduit 26 is connected from a supply source and which internally houses a rod as upward stroke element 16 comprising a recoil enveloping spring (not shown); said piston comprising a first bottom hole (not shown) to the water inlet being in communication with a second transverse hole (not shown) which allows the water supply through a side exit of the piston 18 connected through a supply conduit 31 to the lower intake 32 (see FIG. 3) from the water storage tank 29 of the toilet 30 to fill it when is discharged by pressure differential effect and for driving said second piston 18.

Figure 5:
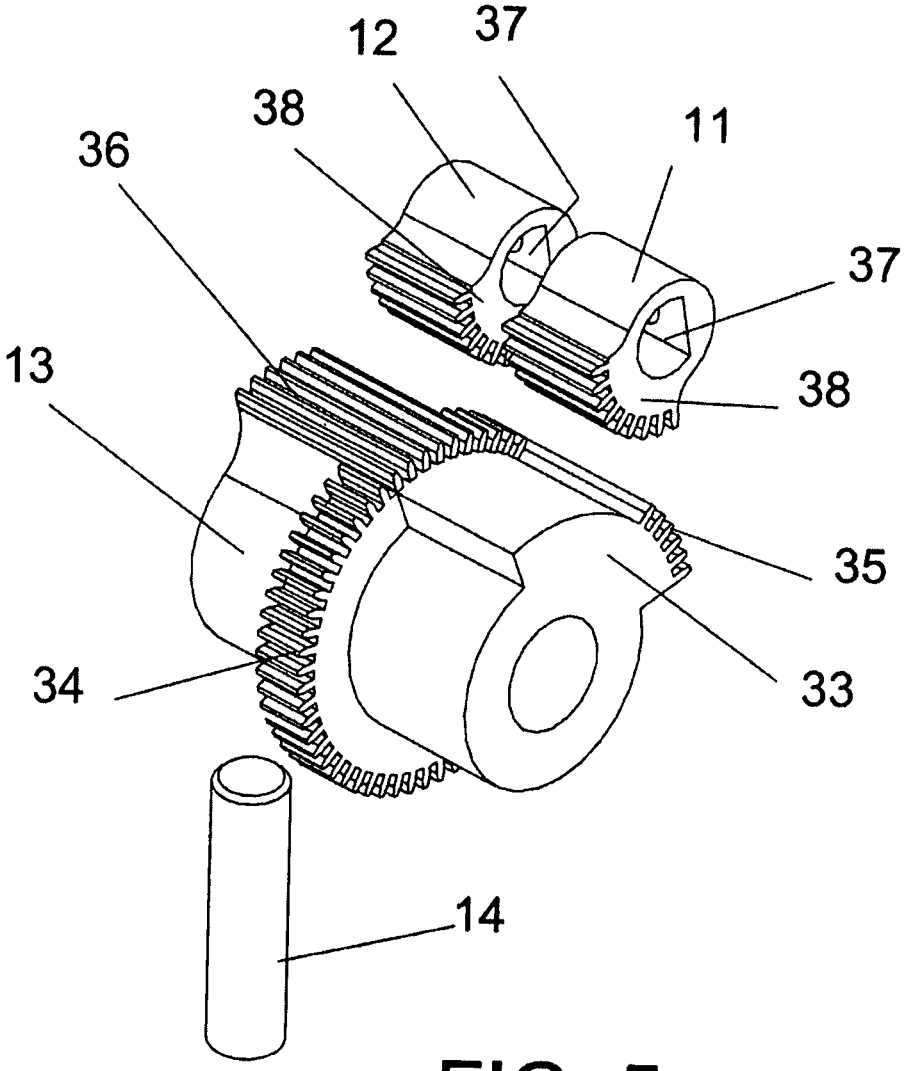
FIG. 5 illustrates a conventional perspective view of the gears of the driving mechanisms for raising and lowering the lid and seat of a toilet in accordance with the present invention.
Figure 6:
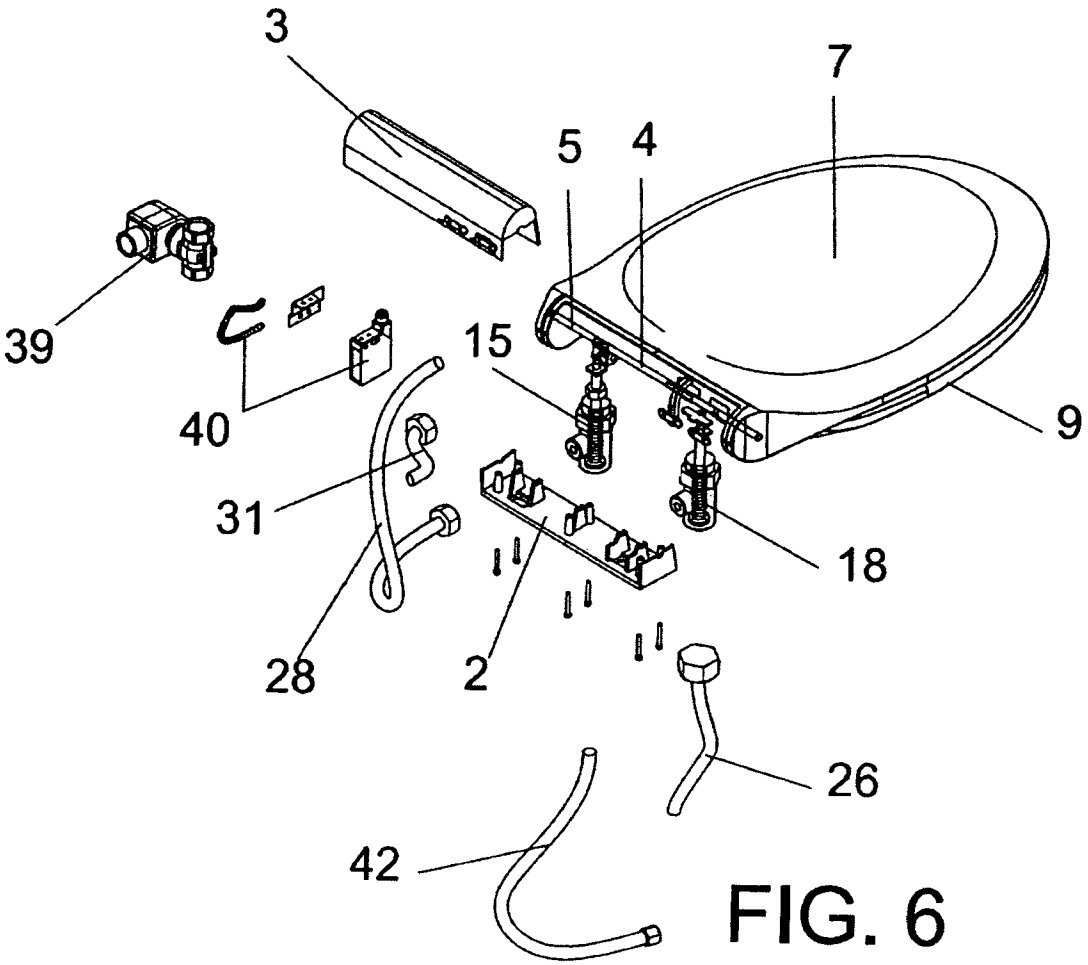
FIG. 6 shows an exploded view of the device with driving mechanisms for raising and lowering the lid and seat of a toilet, in another of the operating embodiments of the mechanisms in accordance with the present invention.
Figure 7:
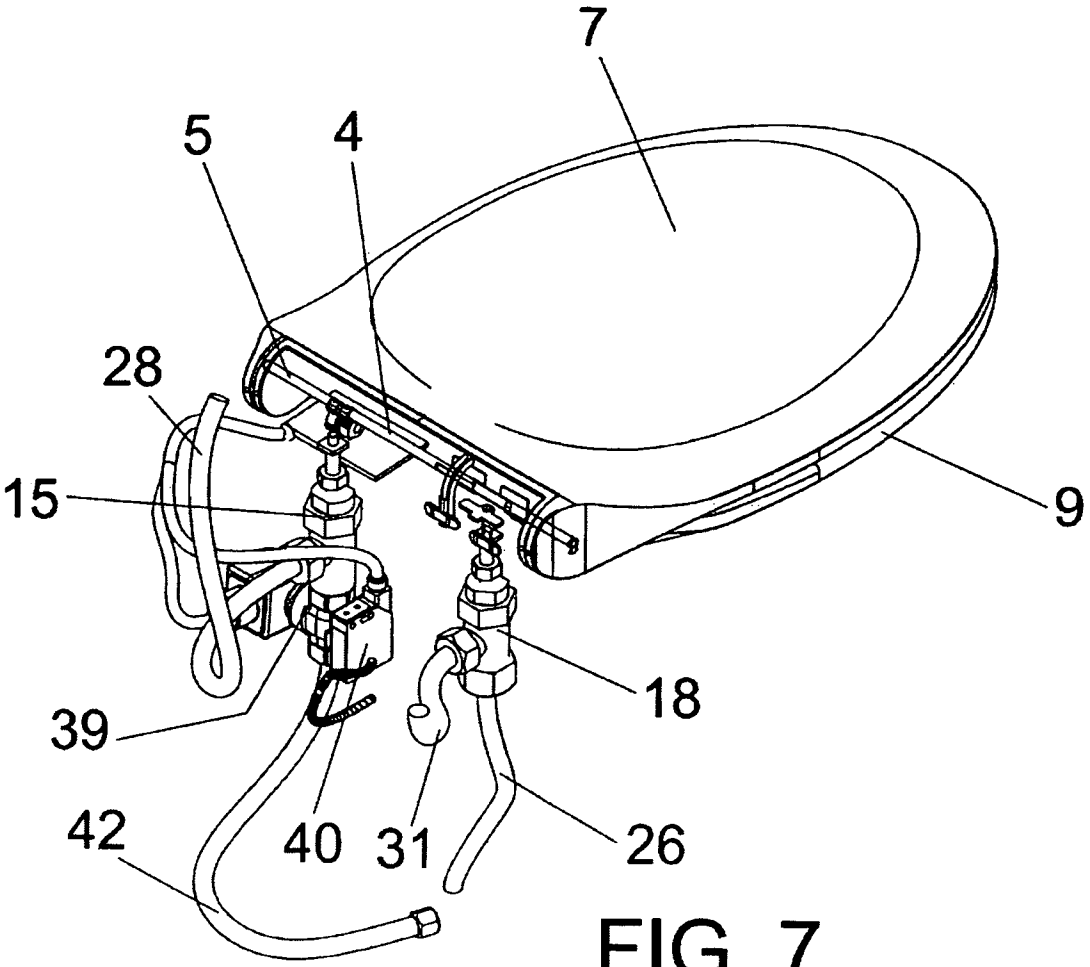
FIG. 7 shows a conventional perspective view of the device with driving mechanisms for raising and lowering the lid and seat of a toilet, in the embodiment shown in FIG. 5.
Figure 12:
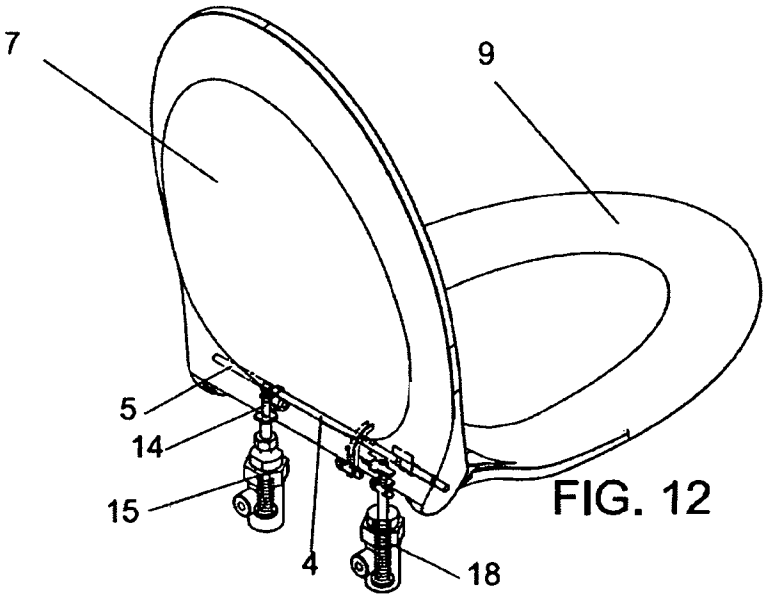
FIG. 12 shows a conventional perspective view of the device without casing, illustrating the actuation of the mechanisms for lifting in a first time the toilet lid.
Figure 11:
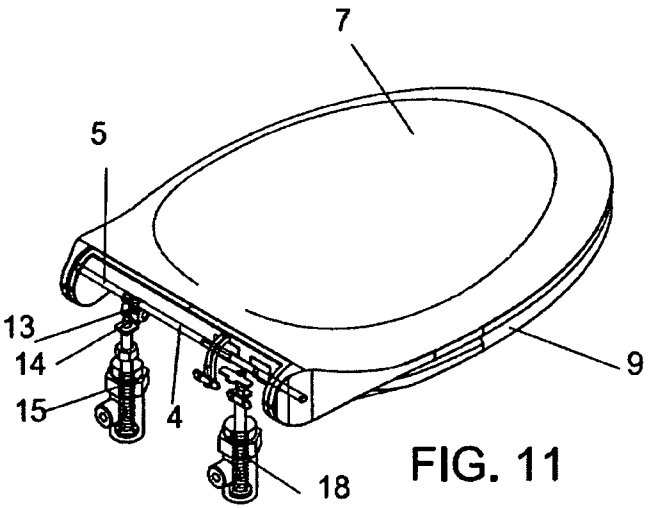
FIG. 11 illustrates a conventional perspective view of the device without casing, when the lid and seat of a toilet are in fold down position.
Figure 14:
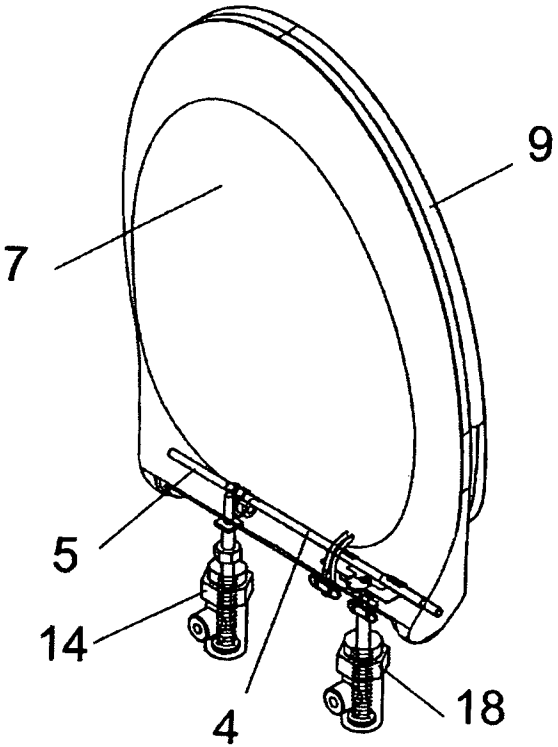
FIG. 14 illustrates a conventional perspective view of the device without casing showing the actuation of the mechanisms when the lid and seat has been lifted and the ascending element descend without actuating the gears to return to its resting position.
Figure 13:
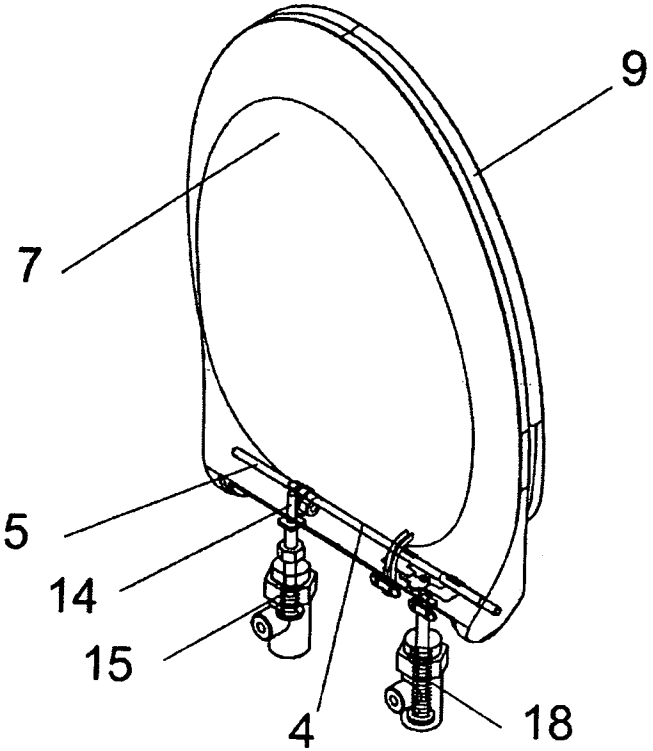
FIG. 13 illustrates a conventional perspective view of the device without casing, showing the actuation of the mechanisms for lifting in a second time the toilet seat.

With reference to FIG. 5, said third driving gear 13 consists of a cylindrical gear comprising a semicircular external protrusion 33; with a central indented zone 34 that runs around the entire perimeter including the semicircular protrusion 33, said protrusion comprises two indented arrays, a first indented array 35 on the right side and a second indented array 36 on the left side of the indented central zone 34, offset of position so that they get combine with said teeth of the central zone; so that said teeth of the central zone 34 are adapted to receive the rod-rack teeth of the piston and said two indented arrays 35 and 36 of the protrusion 33 at each side of the indented central zone 34 of said gear, are adapted to engage with said first gear 11 and second gear 12 for coupling on two times.

Said gears 11 and 12 of the first 4 and second 5 axes, in its preferred embodiment consisting of gears comprising an orifice 37 through which is inserted the corresponding axis end and a semicircular indented protrusion 38 which will engage in the corresponding indented arrays 35 and 36 of the protrusion 33 of said third driving gear 13.

With reference to FIGS. 1 to 5 and 11 to 14, in the embodiment of pedal valve 24, at the device operation, depressing said pedal 24 it is operated the internal valve and allows the water flow from the supplying source through the first conduit 25, through the second conduit 27 towards said first piston 15 to actuate it, if it is left pressed for a short time, is enough to raise the rod-rack 14 which engages in its ascent said third driving gear 13 which in turn engages into a first time with a first indented array 34 on said first gear 11 fixed to the first axis 4 in order to make rotate it and being attached in its end to the lid 7, gradually lift it. If the pressure of the pedal 24 is maintained longer, with the water passage said rod-rack 14 continues its ascent stroke further rotating said third driving gear 13 which in a second time with a second indented array 36 engages in said second gear 12 fixed to the second axis 5 to make it rotate and being connected in its end to the seat 9, gradually lift it.

When the pedal 24 is left to press, the valve closes and stops the flow of water, so that the recoil enveloping spring (not shown) housed within said first hydraulic piston 15 causes back the rod-rack 14 to its resting position without actuating the first gear 11 and second gear 12 and the water within the piston is discharged through said relief duct 31 to the upper part of the water storage tank of the toilet.

Referring to FIGS. 5 to 10, it is observed the mechanism for raising the lid and seat, which is actuated via a two-way solenoid valve; said solenoid valve 39 which is connected at the bottom of the water inlet of the first hydraulic piston 15 and this comprises a presence optical sensor 40 in communication with a motherboard (not shown) housed within the casing and said valve 39 for detecting the presence of a user and operate the valve on two times; a first time when it detects the presence of a user passing the foot or hand on one side of the toilet, the solenoid valve 39 let pass a water flow from the supplying source through a duct 42 connected to the main intake 26 to said first piston 15*b* to drive it, so that the rod-rack 14 of the first piston 15 which at its ascent engages said third driving gear 13 which in turn gears into a first time with a first indented array 35 in said first gear 11 fixed to the first axis 4 to make it rotate and being attached in its end to the lid 7, gradually lift it; if also it is desired to lift the seat, again it is detected the presence of a user passing a second time the foot or hand by a side of the toilet, so that the valve 39 lets pass more water into the hydraulic piston 15 and the rod-rack continues its ascent stroke further rotating said third driving gear 13 which in a second time with a second indented array 36 engages said second gear 12 fixed to the second axis 5 to rotate it and being attached at its end to the seat 9, gradually lift it.

Figure 15:
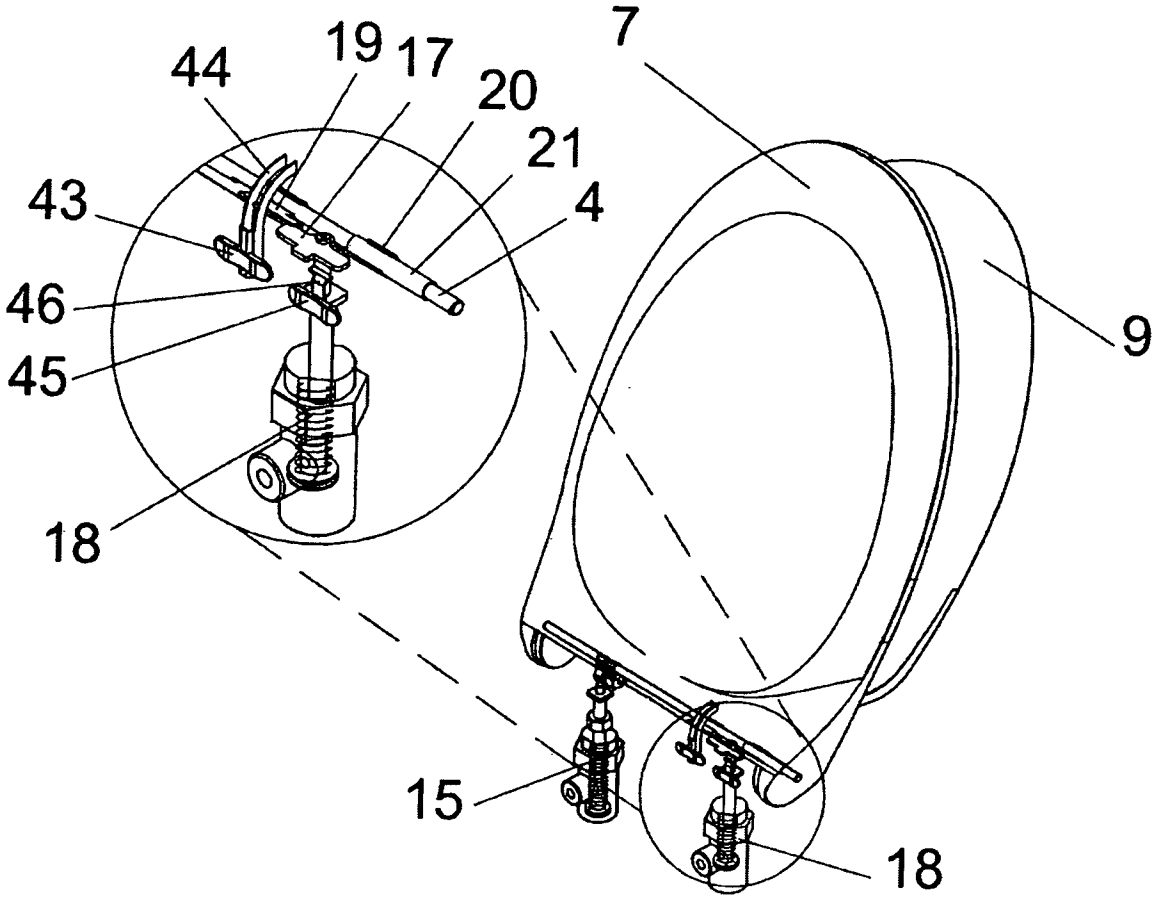
FIG. 15 shows a conventional perspective view of the device without casing with the mechanisms to lower the lid and seat, illustrating their actuation in FIGS. 15*a* and 15*b*.
Figure 15A:
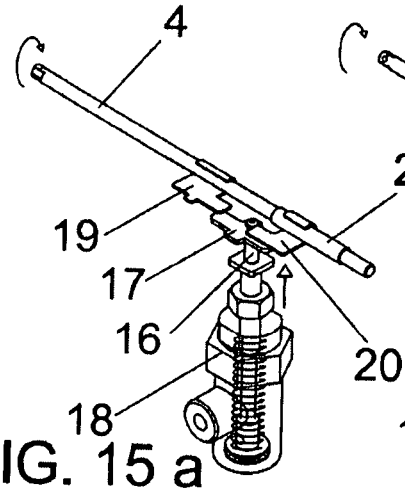
FIGS. 15*a* and 15*b* show the axes and cams which allow the rotation to lower the lid and seat.
Figure 15B:
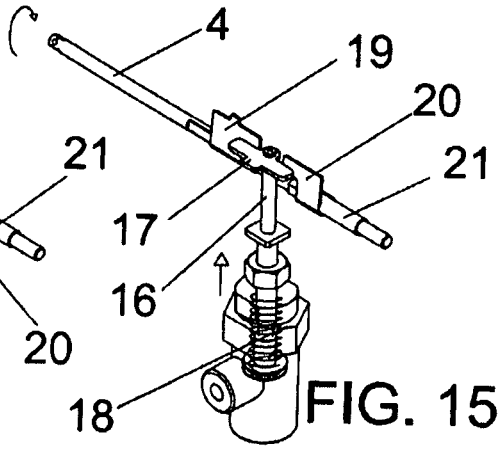
Figure 16:
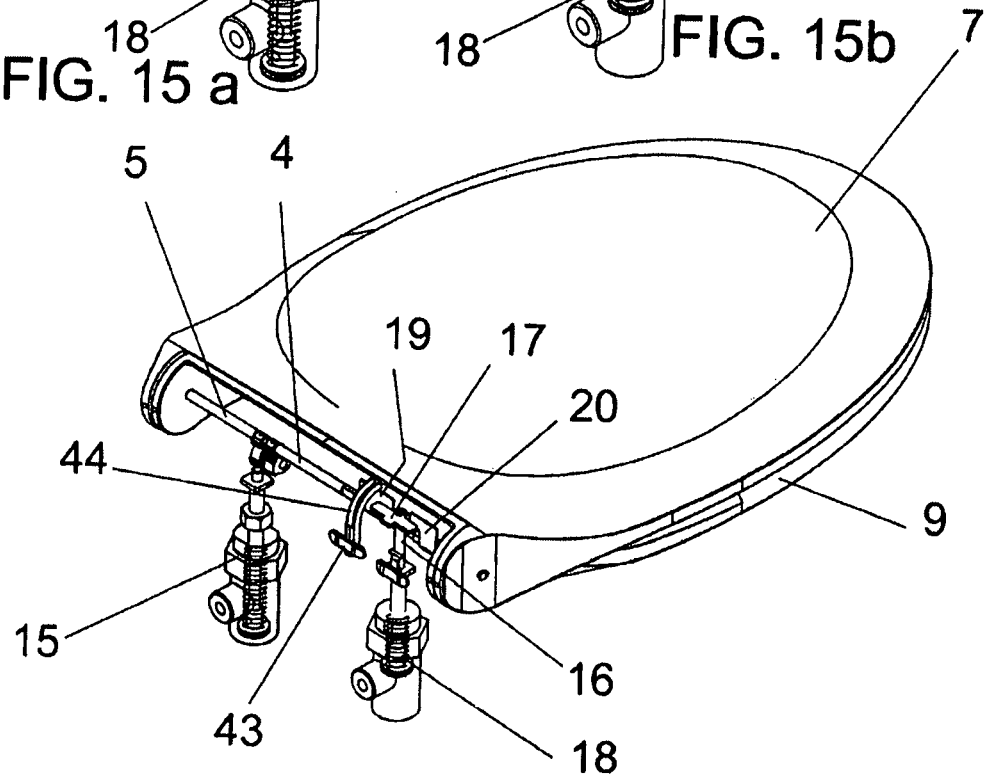
FIG. 16 illustrates a conventional perspective view of the device without casing with the mechanisms to lower the lid and seat which have been driven and have lowered the lid and seat simultaneously.
Figure 18:
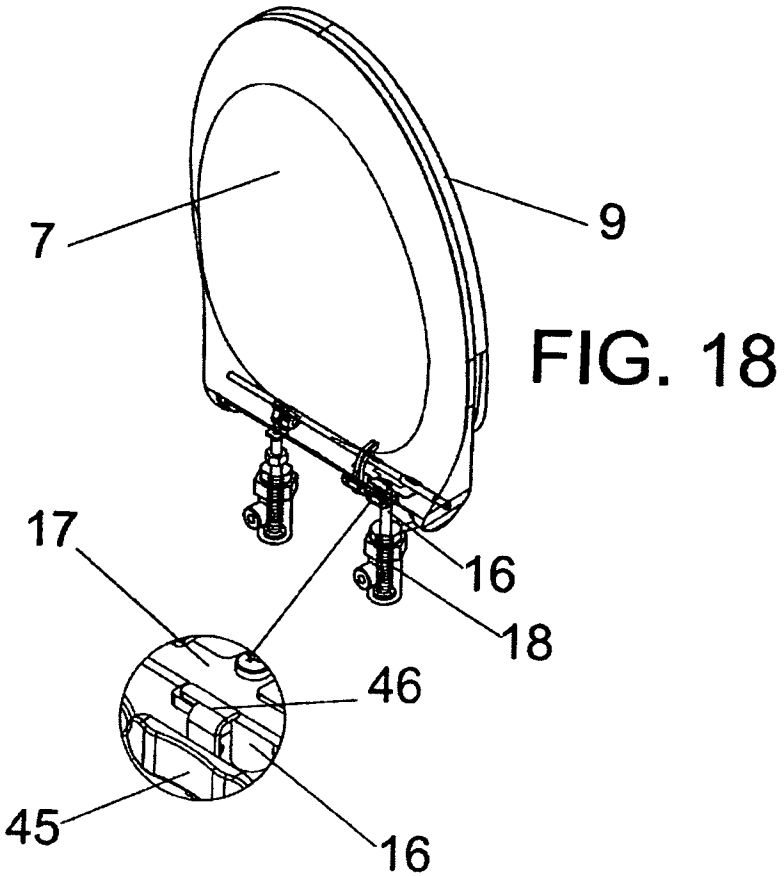
FIG. 18 shows a conventional perspective view of the device without casing with the mechanisms to lower the lid and seat locked in its entirety to prevent the actuation and rotation of the axis attached to the lid and seat to prevent them from down when water from the toilet tank is discharged.
Figure 17:
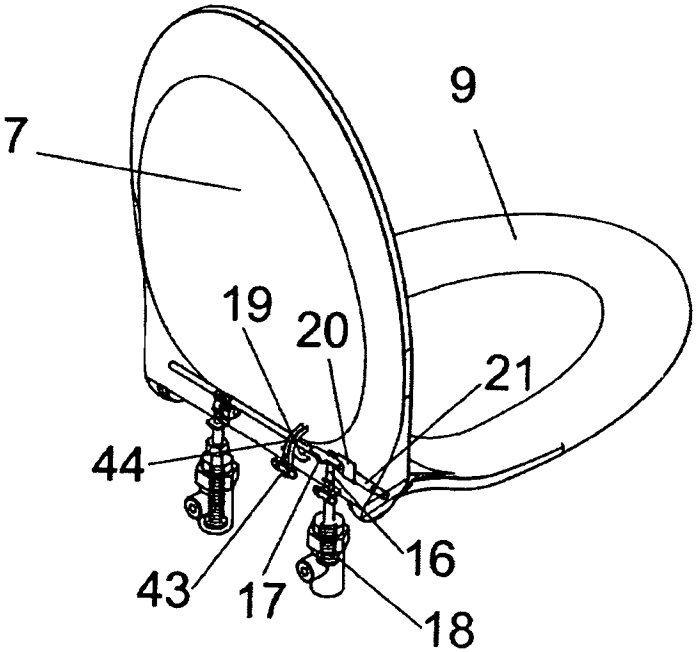
FIG. 17 shows a conventional perspective view of the device without casing with the mechanisms to lower the seat and lid, illustrating the secure element to disable the axis of the lid to prevent it is lowered and only lower the seat.

With reference to FIGS. 1 to 17, and mainly to FIGS. 15 to 17, the second driving device of the second mechanism for lowering the lid 7 and seat 9 simultaneously or independently by the effect of a second movement of rotation in the opposite direction of said first 4 and second 5 axes, consists of a second hydraulic piston 18 of fold down comprising a lower connection where a water supply duct 26 is connected from a supply source and internally houses a rod as upward stroke element 16 comprising a recoil enveloping spring (not shown); said piston 18 comprises a first lower hole (not shown) for water inlet that is in communication with a second transverse hole (not shown) which allows the water supply through a side exit of the piston connected through a supplying duct 31 to the bottom intake of the water storage tank 29 of the toilet 30 for filling it when is discharged by pressure differential effect.

When the toilet 30 is actuated to discharge the water from the tank 29 and dislodge the waste from the toilet, it is generates a pressure differential that allows the pressurized water flow to the second piston of fold down from the supplying source to refill the tank as already described and simultaneously is actuated the rod 16 of the piston 18 that comprises fixedly at its upper end a cross shaped thrust cam, which in its upward stroke abuts and pushes said first cam 19 mounted on said first axis 4 fixed to said lid 7 and to push simultaneously or separately a second cam 20 fixed on a third hollow axis 21 mounted on said first rotatable axis 4 independent and fixed to one of its ends of said seat 9, so that allows fold down the lid 7 and seat simultaneously, or separately by effect of secure elements.

In FIGS. 1 and 15 to 17 mainly shows that said casing comprises secure elements to prevent fold down or lower the lid and locking elements which locks the piston element to prevent fold down or lower the lid and seat; said secure element comprises a button of horizontal stroke 43 mounted on a horizontal groove of the covering 3 and being connected said support-casing structure 1 to a guide rail element 44 which embraces a projection of said first cam 19, which being slidably embraced by said first elongate axis 4 attached to the lid, can move horizontally to remove said first cam 19 and prevent the contact with the cross shaped thrust cam 17 attached to the rod 16; in this way the axis 4 is disabled from the lid and prevents the lid is lowered when the water tank is discharged, pushing only the second cam 20 fixed on said third hollow axis 21 mounted to said first rotatable axis 4 independent and fixed to one of its ends of said seat 9 in order to fold down or lower the seat only.

Said locking element comprises a button 45 slidably mounted in a horizontal groove of the covering 3 of the support-casing structure 1 and which comprises fixedly a locking cam 46; so that when said button 45 slides horizontally said locking cam 46 moves which is disposed over the cross shaped thrust cam 17 obstructing the upward stroke of the rod 16 of the piston 18 and prevents that when is discharged the water tank 29 of the toilet 30, the lid 7 and seat 9 go down automatically.

The invention has been sufficiently described so that a person of ordinary skill in the art to reproduce and obtain the results mentioned in the present invention. However, any person skilled in the technical field to which pertains the present invention may be able to make modifications not described in this application, however, whether to implement these changes in a particular structure or in the manufacturing process of the same, requires the claimed matter in the following claims, such structures will be comprised within the scope of the invention.

What is claimed is:

1. A seat assembly for a toilet having a bowl defining an upper surface, the seat assembly comprising:

a base mountable to the upper surface of the bowl;

a first shaft rotatably mounted to the base and including a first gear aligned along a central axis;

a second shaft rotatably mounted to the base such that the second shaft is collinear with the first shaft and including a second gear;

a seat connected to the first shaft;

a lid connected to the second shaft;

a driving gear having first and second gear sectors spaced axially apart for respectively engaging the first and second gears such that the second gear sector engages the second gear to raise the lid in response to initial rotation of the driving gear, and the first gear sector engages the first gear to raise the seat in response to continued rotation of the driving gear;

a first hydraulic actuator mounted to the bowl and having an output which rotates the driving gear when operated; and a valve including an input device, the valve being in fluid communication with the hydraulic actuator and configured to operate the actuator in response to activation of the input device.

2. The seat assembly of claim 1 wherein activation of the input device for a first period causes the lid to raise and activation of the input device for a second period causes the seat to raise.

3. The seat assembly of claim 1 further comprising a second hydraulic actuator engaging with a cam on the second shaft and configured to rotate the second shaft in a second direction that is opposite the first direction to lower one or both of the lid and the seat when operated.

4. The seat assembly of claim 3 wherein the second hydraulic actuator is automatically operated in response to the tank being discharged.

5. The seat assembly of claim 1 wherein the output of the hydraulic actuator further comprises a rack gear engaging with the driving gear.

6. The seat assembly of claim 5 wherein the first and second gear sectors are circumferentially offset relative to each other.

7. The seat assembly of claim 1 wherein each of the first and second gears define an orifice that receives a corresponding portion of one of the first and second shafts.

8. The seat assembly of claim 1 wherein the first hydraulic actuator is a hydraulic piston powered with pressurized water through the valve, wherein the piston is connected via a relief duct to the tank for discharge to the tank when the piston is deactivated and returns to its resting position.

9. The seat assembly of claim 1 wherein the valve is a pedal valve connected to the pressurized water supply via a first conduit and connected to the first hydraulic actuator via a second conduit.

10. The seat assembly of claim 1 wherein the valve is a two-way solenoid valve connected to the first hydraulic actuator and to a water supply conduit, the solenoid valve including an optical sensor in communication with a motherboard and configured to detect the presence of a user.

11. The seat assembly of claim 1 wherein the output of the first hydraulic actuator is a rod having a rack gear engaging with the driving gear and wherein the hydraulic actuator further comprises a recoil enveloping spring that returns the rod to a resting position when the valve is deactivated, wherein the rod returns to the resting position without causing the first and second gears to rotate.

12. The seat assembly of claim 3 wherein the second hydraulic actuator further comprises a rod having a thrust cam affixed to a distal end of the rod, the thrust cam engaging with the cam of the second shaft to rotate the second shaft in the second direction.

13. The seat assembly of claim 1 wherein the second shaft further includes a first cam affixed to rotate with the second shaft, and a sleeve disposed around the second shaft and connected to the seat, the sleeve including a second cam, wherein the assembly further comprises a second hydraulic actuator mounted to the bowl and including a thrust cam engageable with one or both of the first and second cams to lower one or both of the seat and the lid, wherein engagement of the thrust cam with the first cam lowers the lid and engagement of the thrust cam with the second cam lowers the seat.

14. The seat assembly of claim 13 further comprising a locking element cooperating with the second hydraulic actuator to prevent one of the seat and the lid from lowering.

15. The seat assembly of claim 13 wherein the first cam is displaceable along an axial direction of the second shaft and is movable to a disengaged position where the first cam and the thrust cam do not engage.

16. The seat assembly of claim 15 wherein the first cam is connected with a button and wherein actuation of the button displaces the first cam relative to the shaft in the axial direction.

17. A toilet comprising:

a bowl defining an upper surface;

a seat and lid assembly including a base mounted to the upper surface and collinear first and second shafts supported by the base, the first shaft being connected to a seat and including a first gear aligned along a central axis, and the second shaft being connected to the lid and including a second gear, the first and second gears engaging with a driving gear having first and second gear sectors spaced axially apart for respectively engaging the first and second gears such that the second gear sector engages the second gear to raise the lid in response to initial rotation of the driving gear, and the first gear sector engages the first gear to raise the seat in response to continued rotation of the driving gear;

a hydraulic actuator mounted to the bowl and having an output which rotates the driving gear when operated; and a valve including an input device, the valve being in fluid communication with the hydraulic actuator and configured to operate the actuator in response to activation of the input device.

18. The toilet of claim 17 wherein activation of the input device for a first period causes the lid to raise and activation of the input device for a second period causes the seat to raise.

19. The toilet of claim 17 wherein the hydraulic actuator is a hydraulic piston including a cylinder and wherein the output is a rod displaceable relative to the cylinder.

20. The toilet of claim 19 wherein the bowl further include a ledge portion having a top surface that is coextensive with the upper surface and a bottom surface, the ledge portion defining a hole extending between the top and bottom surfaces, wherein the hydraulic piston is mounted to the bottom surface with the rod extending through at least a portion of the hole.

* * * * *